United States Patent [19]

Pechdo

[11] Patent Number: 4,458,509

[45] Date of Patent: Jul. 10, 1984

[54] TREATED REVERSIBLE SKIN AND A PROCESS FOR TREATING ANIMAL SKINS TO FORM SUCH A REVERSIBLE SKIN

[75] Inventor: Claude Pechdo, Millau, France

[73] Assignee: Tannerie Pechdo Sarl, Millau, France

[21] Appl. No.: 254,422

[22] Filed: Apr. 15, 1981

[51] Int. Cl.[3] ..... C14B 1/00; C14C 3/08

[52] U.S. Cl. ..... 69/21; 8/94.33

[58] Field of Search ..... 69/21; 8/94.15, 94.19 R, 8/94.2, 94.21, 94.22, 94.23, 94.24, 94.25, 94.26, 94.27, 94.28, 94.29, 94.30, 94.31, 94.32, 94.33

[56] References Cited

U.S. PATENT DOCUMENTS 2,009,255 7/1935 Friestedt ..... 69/21
2,102,699 12/1937 Green ..... 69/21

FOREIGN PATENT DOCUMENTS 2626430 12/1977 Fed. Rep. of Germany ..... 69/21
670927 4/1952 United Kingdom ..... 69/21

*Primary Examiner*—Patrick D. Lawson
*Attorney, Agent, or Firm*—Sandler & Greenblum

[57] ABSTRACT

Reversible treated hides are obtained by a process for treating animal skins. The process includes physiochemical operations, such as tanning, retanning, and finishing, to provide an aniline, semi-aniline, or pigmented hair-side appearance on the flesh side of the skin. By providing reversible skins in accordance with the process, finished leather articles can be manufactured without the necessity of providing linings.

19 Claims, No Drawings

TREATED REVERSIBLE SKIN AND A PROCESS FOR TREATING ANIMAL SKINS TO FORM SUCH A REVERSIBLE SKIN

BACKGROUND OF THE INVENTION

1. Field of the Invention

The present invention generally relates to a process for treating the skins of pigs, cattle, horses, goats, and other animals, so that they can be used in the manufacture of unlined finished leather articles.

2. Discussion of Background Art

It is common in the manufacture of finished leather articles to utilize skins treated only on their hair side so as to confer a "full flower", "rectified full flower", or "Nubuck" appearance, the flesh side of the skins being generally coated with a resin layer so as to have a lined appearance, or, during the manufacture of such articles, being coated with a leather lining which necessitates additional operations, such as cutting of the lining and gluing of the lining, on the flesh side of the skin, which result in higher manufacturing costs. Furthermore, the hair side of the skins generally has defects therein due to sticking by insects, barbs, or thorns, or the hair side is separated from the dermis, rendering the damaged portions inappropriate for commercial use, or if such defects are not too apparent and numerous, they at least limit the use of such skins to linings or treated skins of secondary quality.

To eliminate the use of linings, in certain articles, the flesh side, of the skins are treated in a manner so as to give the skins a velvety appearance. Generally, the raw materials treated according to this process are calf, cattle or lamb skins.

In order to limit the volume of losses during the manufacture of clothing articles, such as shoes or the like, animal skins such as calf, cattle, sheep, goat or the like are generally employed. These skins are likely to have fewer defects than other skins, such as the skin of pigs, which are only rarely employed on their hair side, and almost always used with a lining by virtue of the numerous defects present on their hair side.

SUMMARY OF THE INVENTION

It is an object of the present invention to overcome these problems by providing an animal skin treatment process for manufacturing a treated skin utilized in the manufacture of finished leather articles without linings.

It is another object of the present invention to provide a process for the treating of the flesh side of skins without too many defects so as to give it the same appearance as the hair side of the materials actually used.

Another aim of the present invention is to upgrade raw materials generally considered as secondary by virtue of numerous defects which are present on their hair side.

DETAILED DESCRIPTION OF THE INVENTION

To this end, the skin treatment process according to the invention comprises physiochemical operations, such as tanning and retanning, and finishing operations which are characterized essentially in that during river tanning the skins are treated with a lower-than-normal chromium oxide percentage level, and that retanning is carried out with the addition of three basic components, such as glutaraldehyde, vegetable tannins, and urea resins or melanine formaldehyde. The skin is then treated with alimentary oils, and during finishing, the flesh side, which has been previously polished, receives sizings and dressings to render it aniline, semi-aniline, or pigmented.

The process of the invention for treating animal skins such as the hind leather of pig and cattle the half-front of horses, and goat skins in the manufacture of reversible treated skins used in the manufacture of finished leather articles without a lining, consists of physiochemical operations such as tanning and retanning and operations for finishing the flesh side of the skins in order to provide it with an aniline, semi-aniline, or pigmented appearance.

During river tanning, the haired skins are subjected to conventional treatments comprising depilation operations such treatment involves the use of lime and sulfur to release the hairs and to eliminate them. These skins are then fleshed and delimed. The raw skin thus obtained is treated with a percentage of chromium oxide which is smaller than normal, and which preferably constitutes between 1.5 and about 2% with respect to the raw weight of the skin.

After this treatment, the skin is preferably cut or smoothed to render it more uniformly thick by means of any technique known to those skilled in the art.

During the specific retanning, the skins are subjected to the action of three basic components such as glutaraldehyde, vegetable tannins, and urea resins or melanine formaldehyde.

The glutaraldehyde is employed in a percentage on the order of 3–6% of the cut weight, depending upon the type of skin treated, and serves to facilitate fiber removal of the skin to provide it with a good resistance to sweat and to facilitate penetration of vegetable tannins, known in themselves, such as extracts of mimosa, chestnut, quebrado, employed in the form of concentrated extracts, in proportions of 12 to 20% of the cut weight.

These tannins provide the treated skin with a good compactness to facilitate preparation of the flesh side for finishing.

The urea resins or melanine formaldehyde are used in proportions of 1.5 to 3% of the cut weight serve to even out the texture of the leather as a function of the type of skin used. Preferably, in the treatment of pig butts, these resins are used in amounts of 1.5% of the cut weight.

Depending upon the desired flexibility of the leather and the material employed, the skin is then treated with alimentary oils of any of the types known to those of skill in the art. Preferably, the percentage of alimentary oils is between 2.5 and 6% with respect to the cut weight.

Before the finishing operations are performed the flesh side of the skin is preferably polished by any known means to provide a fine and uniform surface.

These finishing operations serve to provide a flowered appearance of an aniline, semi-aniline, or pigmented character to the flesh side of the treated skin. In the manufacture of finished articles made of pig leather, the flesh side can be utilized to form the exterior surface of the article, the haired side, which is less apparent, thus forming the interior surface without the necessity of attaching a lining.

To provide the appearance of a hair side to the flesh side so that it will have an aniline character, the leather is tinted with a colored flesh dye, preferably applied with a gun or with a curtain machine, and with one or more layers of smoothable resins of any known type, whether or not colored, which are preferably applied with a gun. The flesh side of the skin is then subjected to mechanical surface treatment, such as pressing or smoothing.

Before any treatment, and in order to provide a semi-aniline or pigmented appearance, depending upon the type of material used, the flesh side of the leather can be impregnated with acrylic resin of low molecular weight, which will then be vacuum-dried and lightly polished to facilitate the base treatment. This treatment is carried out by means of cationic binders, preferably colored, ones which even out the penetration and fixation of other finishing layers. Furthermore, particularly for pig skins, these binders serve to block the silk channels which go from one side to the other of the dermis of the skin. The semi-aniline or pigmented hair-side appearance is obtained by the application, on the flesh side, of one or more layers having a colored or pigmented polyurethane binder base, and by the application of casein.

To confer to pig leather, as well as to other leathers considered to be of secondary quality, mechanical characteristics analogous to those of the types of leather actually used, one or more protective layers of polyurethane lacquered base can be applied.

The leather is then, and during finishing, subjected to mechanical plating or smoothing operations of the resin and lacquer layers. The hair side of the leather can have a satin or shiny appearance by applying lacquered and smoothable resins, which are in themselves known, by any appropriate means.

The reversible treated skin obtained according to the process as defined above can be used in the manufacture of finished leather articles without a lining. Furthermore, the process defined above allows for the treatment and use of raw materials which are generally considered to be of secondary quality, which diminishes the cost of the finished products.

It is self evident that the invention contemplates and can include all modifications and variations without going beyond the scope of the patent.

I claim:

1. A process for treating an animal skin having a hair side and a flesh side which includes subjecting the skin to physiochemical operations to form a reversible treated skin utilized in fabricating leather articles without linings, said process comprising:

(a) river-tanning said skin with a relatively low percentage of chromium oxide;

(b) retanning said skin with a plurality of components;

(c) treating said skin with food-quality oils; and (d) sizing and finishing the flesh side of said skin to provide it with a desired hair side appearance.

2. A process in accordance with claim 1 wherein said animal skin is chosen from the group consisting of pig skin, horse skin, cattle skin, and sheep skin.

3. A process in accordance with claim 1 wherein said components comprise glutaraldehyde, vegetable tannins, and urea resins.

4. A process in accordance with claim 1 wherein said flesh side of said skin is polished prior to being sized and finished.

5. A process in accordance with claim 1 wherein said skin is treated with a percentage of chromium oxide which is between 1.5% and 2% of the raw weight of said skin.

6. A process in accordance with claim 3 wherein said glutaraldehyde is present in an amount between 3% and 6% of the cut weight of the skin, the precise percentage being determined as a function of the nature of the skin being treated.

7. A process in accordance with claim 3 wherein said vegetable tannins are present in an amount between 12% and 20% of the cut weight of said skin.

8. A process in accordance with claim 3 wherein said urea resins are present in an amount between 1.5% and 3% of the cut weight of said skin.

9. A process in accordance with claim 1 wherein said components comprise glutaraldehyde, vegetable tannins, and melanine formaldehyde.

10. A process in accordance with claim 9 wherein said melanine formaldehyde is present in an amount between 1.5% and 3% of the cut weight of said skin.

11. A process in accordance with claim 1 wherein said skin is treated with food-quality oils which are present in an amount between 2.5% and 6% of the cut weight of said skin.

12. A process in accordance with claim 1 wherein said appearance is a pigmented appearance.

13. A process in accordance with claim 1 wherein said appearance is an aniline appearance.

14. A process in accordance with claim 13 wherein said aniline appearance of said flesh side is produced by a colored flesh dye.

15. A process in accordance with claim 14 wherein said colored flesh dye is applied either with a pistol or with a curtain machine.

16. A process in accordance with claim 13 wherein said aniline appearance is produced by application with a pistol of smoothable resins which are colored, mechanically pressed, and smoothed.

17. A process in accordance with claim 1 wherein said appearance is a semi-aniline appearance.

18. A process in accordance with either of claims 12 or 17 wherein said appearance is provided to said flesh side by impregnating said flesh side with a basic treatment, including colored cationic binders, layers of colored or pigmented polyurethane binders, caseins, protective layers of polyurethane lacquer bases, wherein said resin and said lacquer layers are mechanically plated.

19. A reversible treated skin formed in accordance with the process of claim 1.

* * * * *